US005518282A

United States Patent [19]

Sawada

[11] Patent Number: 5,518,282

[45] Date of Patent: May 21, 1996

[54] LOCKING DEVICE FOR OPEN-CLOSE MECHANISM OF A CABINET

[75] Inventor: Hiroshi Sawada, Hirakata, Japan

[73] Assignee: Koei Sangyo Co., Ltd., Japan

[21] Appl. No.: 288,130

[22] Filed: Aug. 10, 1994

[30] Foreign Application Priority Data

Nov. 30, 1993 [JP] Japan ..... 5-298786
Mar. 14, 1994 [JP] Japan ..... 6-041627

[51] Int. Cl.[6] ..... E05C 17/56; E05C 19/00

[52] U.S. Cl. ..... 292/252; 292/251.5; 292/128

[58] Field of Search ..... 292/128, 130, 292/224, 251.5, 252, 333, 341.17, DIG. 22, DIG. 65; 70/67, 78, 84, 85

[56] References Cited

U.S. PATENT DOCUMENTS

| | | | |
|---|---|---|---|
| 3,201,960 | 4/1965 | Berkowitz | 292/251.5 |
| 3,919,869 | 11/1975 | Fromm | 292/341.17 |
| 4,270,781 | 6/1981 | Nishimura | 292/251.5 |
| 4,652,029 | 3/1987 | Yamamoto | 292/252 |
| 4,739,896 | 4/1988 | Moss | 292/130 |
| 4,865,368 | 9/1989 | McCall | 292/252 |
| 5,035,451 | 7/1991 | Brady | 292/DIG. 22 |
| 5,106,132 | 4/1992 | Bako | 292/128 |
| 5,152,562 | 10/1992 | Stevenson | 292/252 |
| 5,312,143 | 5/1994 | Buckner | 292/DIG. 22 |

FOREIGN PATENT DOCUMENTS

| | | | |
|---|---|---|---|
| 18106 | 10/1980 | European Pat. Off. | 292/130 |

*Primary Examiner*—Steven N. Meyers
*Assistant Examiner*—Gary Estremsky
*Attorney, Agent, or Firm*—Lalos & Keegan

[57] ABSTRACT

A locking device for the open-close mechanism such as door, drawer and the like of a cabinet, such as cupboard and the like, comprises a fastening member attached to either the open-close mechanism or the cabinet and a lock unit attached to the other counterpart. The lock unit is provided with a lock lever for fastening and unfastening a hook to the fastening member by rotating, and a rolling body which controls rotation of the lock lever in the releasing direction by moving into the path of rotation of the lock lever if the cabinet swings, thus preventing the open-close mechanism of the cabinet from opening in case of an earthquake or the like.

13 Claims, 12 Drawing Sheets

LOCKING DEVICE FOR OPEN-CLOSE MECHANISM OF A CABINET

FIELD OF THE INVENTION

The present invention relates to a locking device for open-close mechanism, i.e. door, drawer and the like, to be secured to a cupboard of a kitchen or a cabinet for storing articles.

BACKGROUND OF THE INVENTION

Open-close mechanisms represented by doors, drawers and the like of a cabinet are often designed to be maintained in the closed state by means of a magnetic catch utilizing magnetic attractive force. Other means of maintaining the closed state of an open-close mechanism includes one which comprises a claw which is withdrawn under a pressing force applied against the open-close mechanism. The maintaining means is constructed so as to engage this claw in a fastening hole provided in the open part of a cabinet.

However, such devices present a problem when a large external force is applied to the cabinet, i.e. when the cabinet swings with an earthquake, for example. Namely, the swinging motion of the cabinet unlocks and opens the open-close mechanism, allowing the goods stored inside the cabinet to fall out of the cabinet and be damaged. Another problem is that a person near the cabinet may be injured by the articles falling out of the cabinet.

In the conventional mechanisms, no protective means is provided to prevent the open-close mechanism of a cabinet from opening from some unexpected force such as an earthquake or the like.

SUMMARY OF THE INVENTION

The object of this invention is to maintain the open-close mechanism of a cabinet in the locked state in the event of any sudden force (such as an earthquake) on the cabinet, while making it impossible to easily unlock the open-close mechanism by manual operation.

The structures of the invention for achieving the object are as follows.

(1) This invention is a device for locking an open-close mechanism such as door, drawer and the like provided on a cabinet in a way as to be freely opened or closed, comprising a fastening member attached to either the open-close mechanism or the cabinet and a lock unit attached to the other of the open-close mechanism or cabinet.

The lock unit is provided with a lock lever for fastening and unfastening a hook to and from the fastening member by rotating, and a freely rolling body that is so constructed so as to move to a position where releasing of the lock lever is prevented when the cabinet swings.

(2) The lock unit is provided with a lock lever for fastening and unfastening a hook to and from the fastening member by rotating, a freely rolling body and an unlocking means that is so constructed as to cause the rolling body to roll out to a position where releasing of the lock lever is prevented.

(3) The lock unit consists of a lock lever having a hook at the front end, a control lever, first and second springs and a rolling body.

The lock lever is rotatively supported on a horizontal shaft on the base member of the lock unit and is pressed by the first spring in such a way that the hook moves downward into a locking position. The lock lever is formed, on its lower side, with a tapered face which acts under the force of the second spring for moving the hook upwardly into an unlocked position.

The control lever, slidably positioned under the bottom of the lock lever in the longitudinal direction, is pressed forward by the second spring which has a larger pressing force or strength as compared with the first spring. The front part of the control lever is made to protrude from the base member and includes a projection on its back for pushing against the tapered face of the lock lever.

Moreover, the control lever is constructed so as to bend in a conical shape with the application of a force in the axial direction, which makes the rolling body roll out from between the bottom face of the lock lever and the top face of the control lever.

(4) In the construction as provided in paragraph (3) above, the rolling body is formed as a ball made of a ferromagnetic material. And, inside the lock unit, a magnetic holding means is provided for stabilizing the position of the ball between the lock lever and the control lever.

If, in the construction of paragraph (1) mentioned above, the open-close mechanism such as door and the like is closed, the hook of the lock lever engages with the fastening member to maintain a state in which the open-close mechanism is closed. In case of any swinging of the cabinet resulting from an earthquake and the like, the rolling body rolls under the lock lever and functions to prevent any rotation and release of the lock lever. For that reason, the open-close mechanism does not open and the articles stored inside the cabinet do not come out even swinging or the like of the cabinet, thus improving the safety of the cabinet.

Further, in the construction as disclosed in paragraph (2) above, the rolling body preventing the rotation in the releasing direction of the lock lever is driven out of position by a releasing means, as mentioned previously. The releasing means is designed to make the rolling body roll out by the action of the control lever in response to a force from the open-close mechanism, or the like, and this motion of the rolling body makes it possible for the lock lever to rotate freely to unlock the open-close mechanism.

Moreover, if, in the construction of paragraph (3) above, the open-close mechanism such as door and the like is closed, the hook of the lock lever engages with the fastening member to maintain a state in which the open-close mechanism is closed. If the open-close mechanism is pulled forward, i.e. outward from the cabinet, in this state, the pressure of the control lever is released and the control lever moves forward allowing the lock lever to rotate in the releasing direction, disengaging the hook of the lock lever from the fastening member and releasing the open-close mechanism.

If, in the state where the open-close mechanism is closed and the hook is engaged with the fastened member, the cabinet is subject to some force from an earthquake or the like, and swings, the rolling body in the lock unit rolls out and is positioned between the lower side (at the rear part) of the lock lever and the top face of the control lever. For that reason, the rear part of the lock lever hits against the rolling body and cannot turn in the releasing direction.

This makes it possible to keep the hook in the state engaged with the fastening member and maintain the open-close mechanism in the closed state, thus preventing the articles stored inside the cabinet from falling out of the cabinet.

To open the open-close mechanism in the state where the releasing of the lock lever is prevented by the rolling body, one presses the open-close mechanism in the direction of the cabinet.

With this motion, the control lever protruding from the base member is pressed and bends in a conical shape. Consequently, the rolling body positioned on the control lever rolls rearward to a position away from the lower part of the lock lever so as to enable release of the lock lever. The hook can then be detached from the fastening member, allowing the open-close mechanism to be opened.

Since rotation in the releasing direction of the lock lever can be prevented by the rolling body as described above, the open-close mechanism can maintain the closed state when the cabinet swings from the force of an earthquake or the like. It becomes possible therefore to prevent any accident of falling articles stored in the cabinet.

In the construction as described in paragraph (4) above, the locking device acts basically the same as in the embodiment described in paragraph (3). In one embodiment the rolling body is formed as a ball made of a ferromagnetic material. The locking device magnetically attracts the rolling body which rolls to the lower side at the rear part of the lock lever which has a magnetic holding means i.e. a magnet provided on the lower side of the lock lever. By so doing, the locking device can hold the ball in position on the lower side at the rear part of the lock lever and prevent it from rolling out. It can therefore securely prevent any rotating in the releasing direction of the lock lever. Namely, it securely maintains the open-close mechanism in the closed state and thus further improves the safety.

DESCRIPTION OF THE PREFERRED EMBODIMENTS

Figure 1:
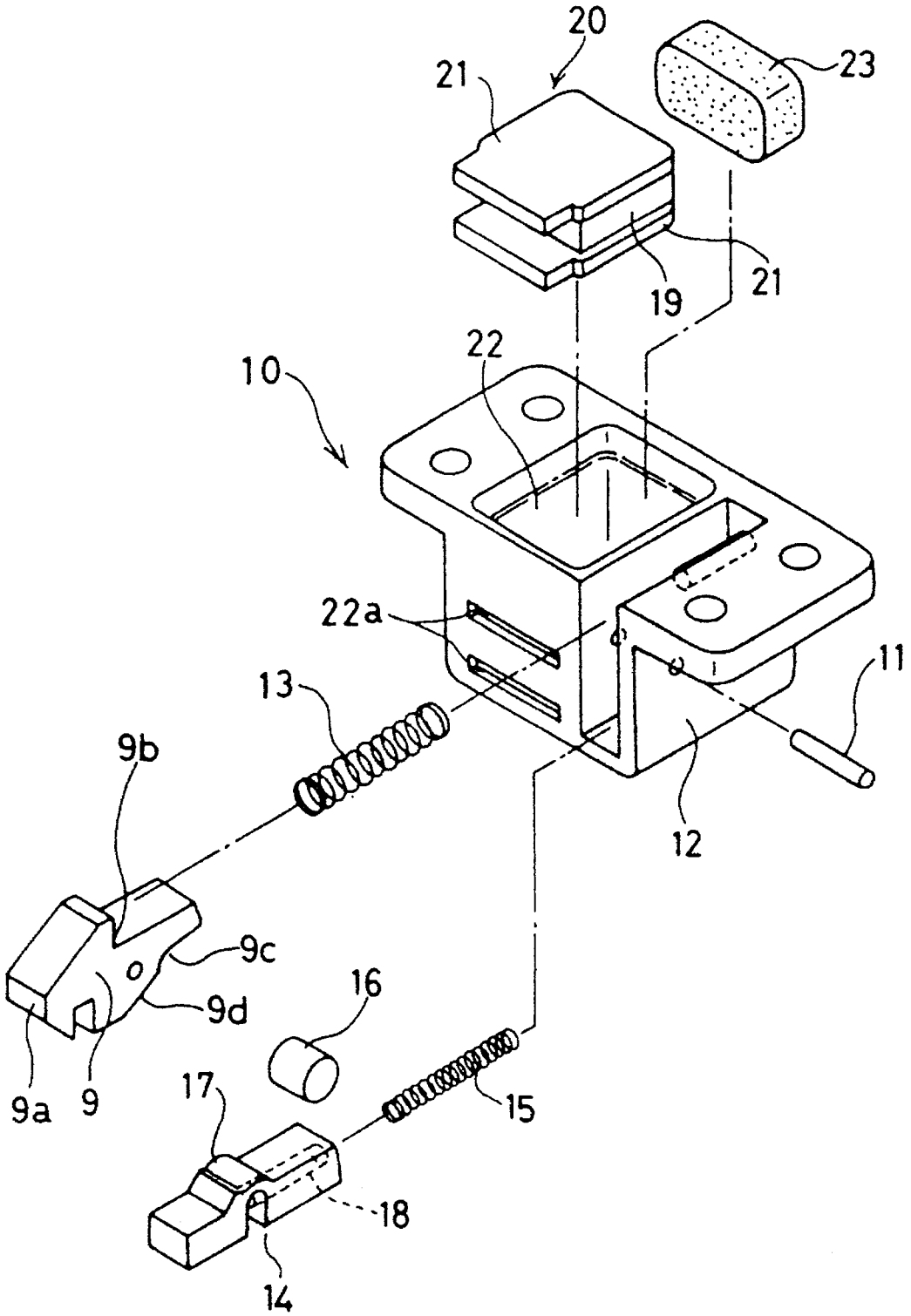
FIG. 1 is an exploded perspective view of the lock unit in the locking device for an open-close mechanism of a cabinet of the first embodiment of the present invention.
Figure 2:
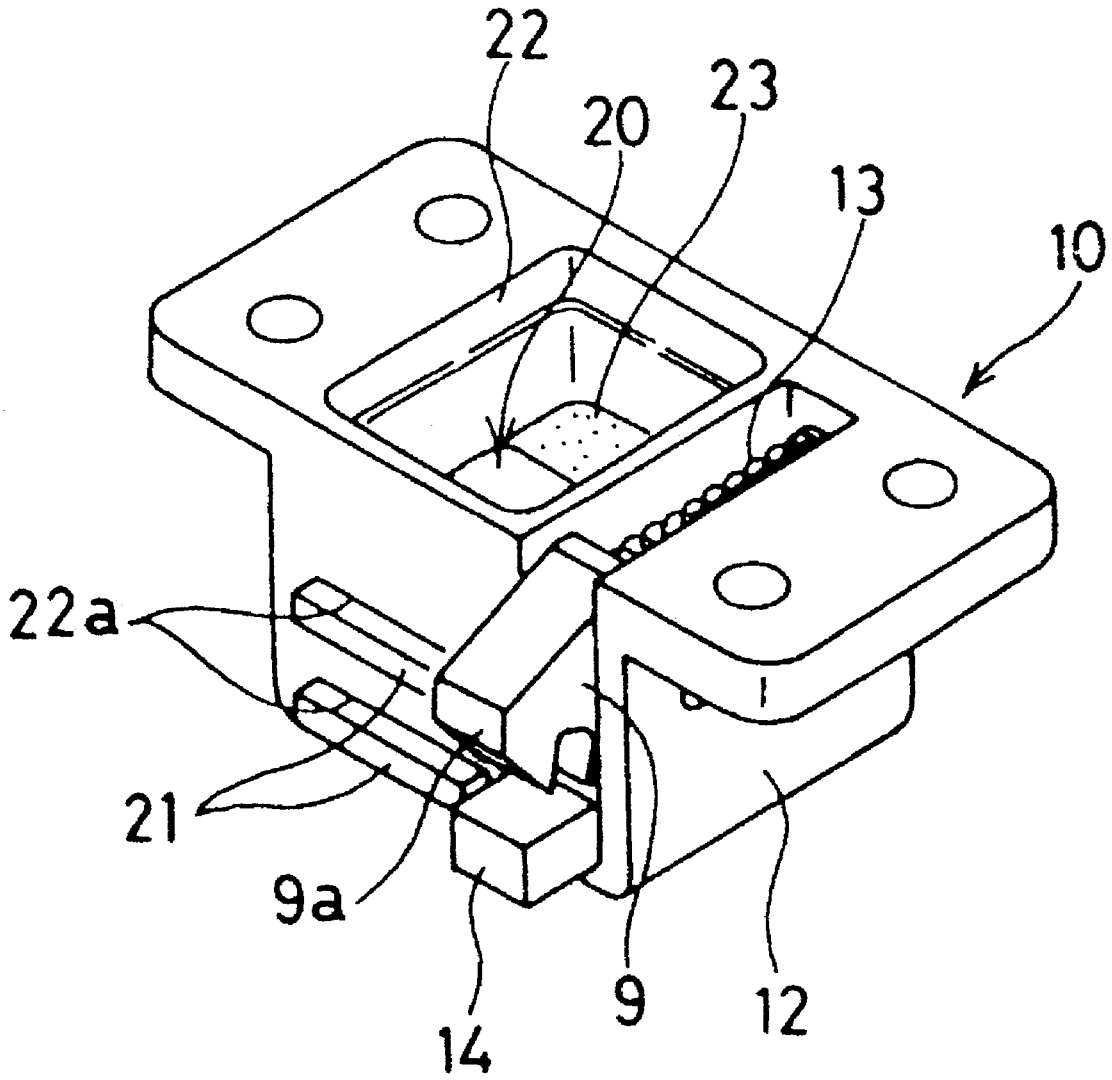
FIG. 2 is a perspective view in assembled state of the lock unit.

An explanation will be given hereafter on the first embodiment indicated in FIG. 1–FIG. 7.

The cabinet 1 (FIG. 3) has, at the upper part on the front face a storing unit 3 which can be opened and closed with a turning door 2. Moreover, at the lower part of the cabinet 1, a storing unit 5 is formed with drawers 4 in two stages (upper and lower).

The door 2 is attached to the cabinet 1 by means of a hinge (not illustrated) on one side and is rotatable around a vertical shaft center. The other side of the door 2 is held in the closed position by means of locking device 6.

The locking device 6 consists of a fastening fixture 7, which is attached to the inner face on the free end side of the door 2, with the upper edge of fixture 7 serving as an engaging edge, and a lock unit 10 attached to the inner face of the top plate 8 of the cabinet 1 at a position corresponding to the fastening fixture 7.

The lock unit 10 has a lock lever 9 (FIG. 1) rotatably supported on a shaft 11 placed in the horizontal direction. The lock lever 9 has a hook **9*a* at the front end and the hook 9*a* protrudes in the front direction from the base member 12. The lock lever 9 is pressed by a first spring 13 in such a way that the hook 9*a* engages with the fastening fixture 7 i.e. with the front end looking downward. This first spring 13 is provided between a step 9*b* positioned in the center at the top of the lock lever 9 and the inner face at the rear end of the base member 12. Moreover, the lock lever 9 has a dent 9*c* at the bottom face in the rear part and a tapered face 9*d* positioned in front of the dent 9*c***.

The lock unit 10 has a control lever 14 as a member. The control lever 14 disposed below the lock lever 9 is positioned in a way to be slidable in the longitudinal direction. The control lever 14 is pressed forward by a second spring 15 and its front end protrudes from the front part of the base member 12. The pressing force of the second spring 15 is set larger than the pressing force of the first spring 13. The control lever 14 is made of an elastic material such as polypropylene and the like and has a thin hinge 17 at the center in the longitudinal direction. This hinge 17 forms a projection which swells to function as a presser, and is in contact with the tapered face **9*d* of the lock lever 9**.

The lock unit 10 has, as member, a rolling body 16 in the shape of a roller or a ball. This rolling body 16 is placed on the top face in the rear part of the control lever 14 so that it may roll forward to be positioned in the turning range of the lock lever 9 when the cabinet 1 swings and becomes secured in position at the dent **9*c* on the bottom face in the rear part of the lock lever 9**.

Furthermore, the lock unit 10 has, as member, a magnetic catcher 20. The magnetic catcher 20 consists of a magnet 19 and two magnetic metal sheets 21, 21 holding the magnet, and is stored in the storing unit 22 of the base member 12 together with an elastic support 23. The tips of the magnetic metal sheets 21, 21 protrude in the forward direction from the openings 22*a* of the base member 12.

The actions of the locking device of the above-mentioned construction will be explained hereafter with reference to FIG. 4– FIG. 6.

Figure 4:
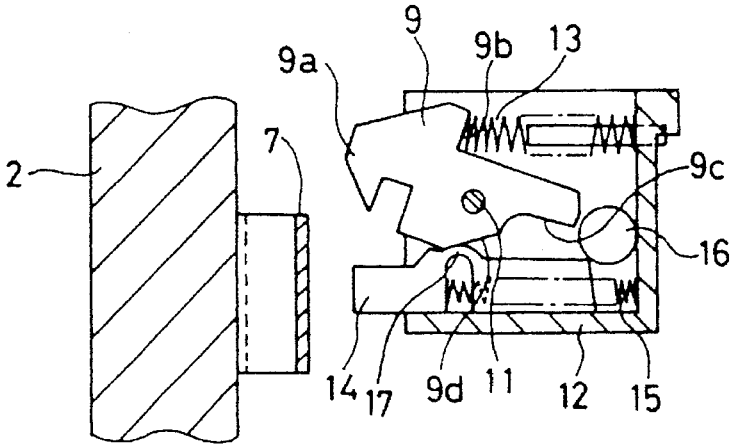
FIG. 4 is a cross-sectional view of the lock unit in the state where the door is open.

As shown in FIG. 4, when the door 2 is opened, the control lever 14 is pushed by the second spring 15 and protrudes forward from the base member 12 at the maximum length. The hinge 17 protruding at the upper part of the control lever 14 pushes the tapered face 9*d* of the lock lever 9 to rotate the lock lever 9 in the direction where its front end moves upward i.e. in the releasing direction. In such case, the rolling body 16 is in the rearmost position and the lock lever 9 is free to rotate.

Figure 5:
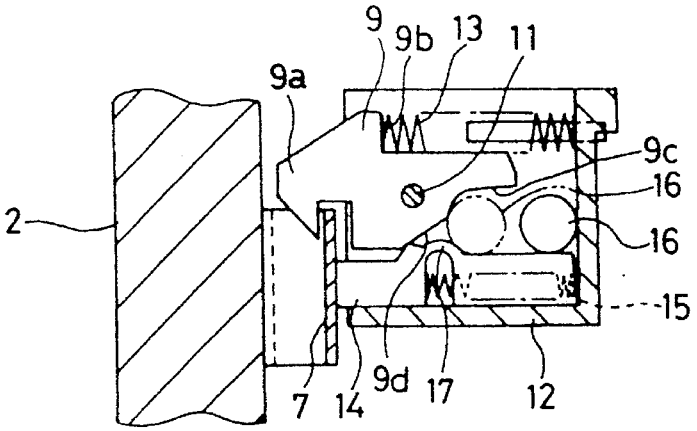
FIG. 5 is a cross-sectional view of the lock unit in the state where the door is closed.

As shown in FIG. 5, when the door 2 is closed, the fastening fixture 7 provided on the door 2 makes the control lever 14 retreat. The lock lever 9, which is released from the pressure of the control lever 14, rotates under the pressure of the first spring 13 in such a way that the hook 9*a* moves downward and the hook 9 engages with the fastening fixture 7. At the same time, the magnetic catcher 20 attracts the fastening fixture 7.

Under normal conditions, the door 2 remains in this state. To open the door 2, one pulls the door 2 in the forward direction with a force larger than the attractive power of the magnetic catcher 20. This makes the hook 9*a* turn, with the fastening fixture 7, in the releasing direction against the pressing force of the first spring 13 and the door 2 can be opened easily.

The most important actions of this locking device are as follows: If, in the state where the door 2 is closed as shown in FIG. 5, the cabinet 1 swings as a result of an earthquake or the like, the rolling body 16 rolls forward and comes to the position indicated with a two-dot chain line in FIG. 5. Namely, the rolling body 16 rolls in between the dent 9*c* at the bottom face in the rear part of the lock lever 9 and the control lever 14. Rotation of the lock lever 9 is prevented with the presence in this position of the rolling body 16. Consequently, the hook 9*a* of the lock lever 9 remains in the position engaged with the fastening fixture 7 and the door 2 does not open. For that reason, the goods stored in the cabinet 1 do not come out and safety is ensured.

Figure 6:
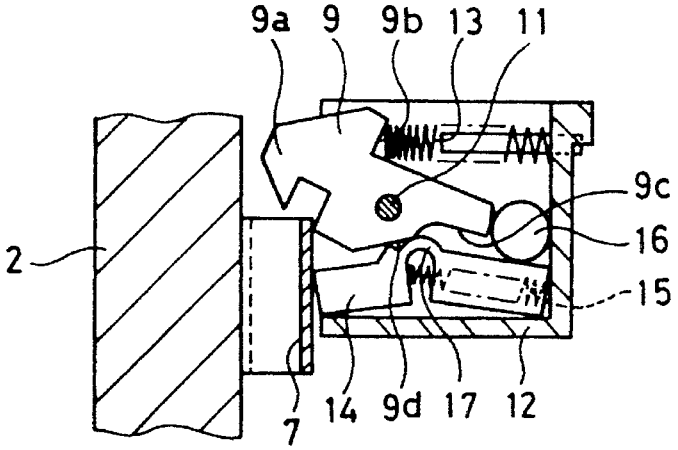
FIG. 6 is a cross-sectional view of the lock unit in an unlocked state.
Figure 7:
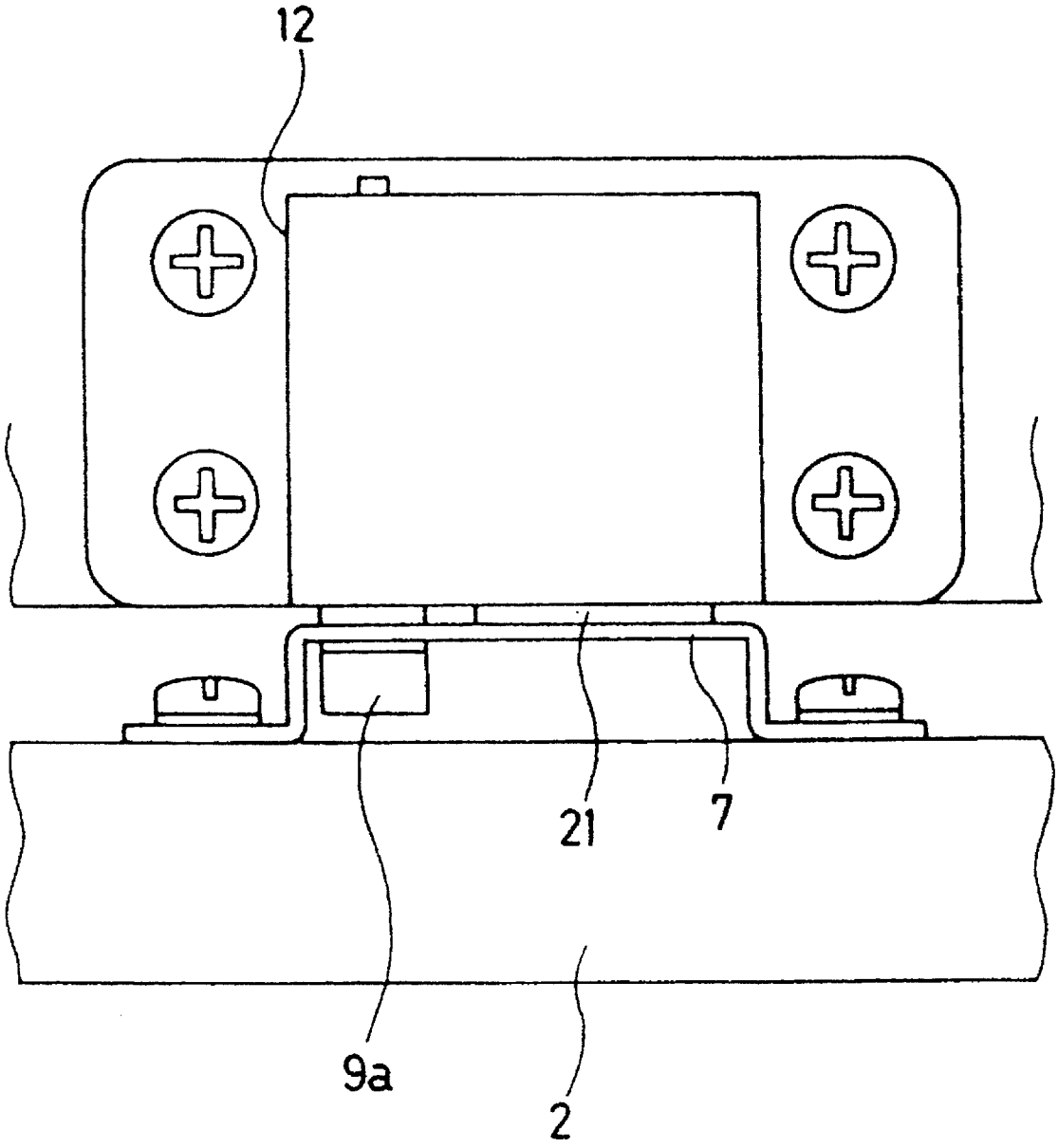
FIG. 7 is a bottom view of the lock unit in the state where the door is closed.
Figure 8:
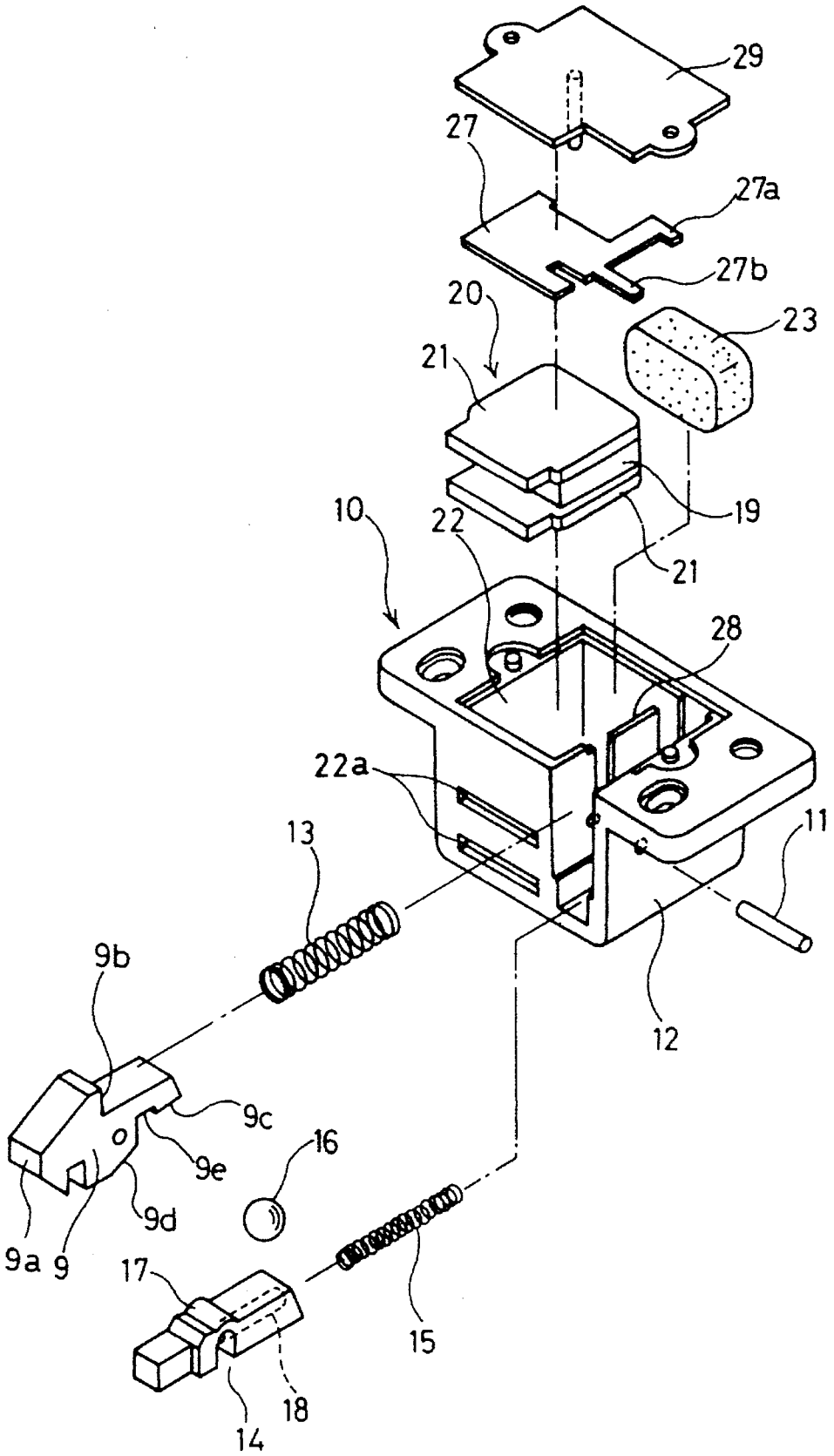
FIG. 8 is an exploded perspective view of the lock unit in the locking device for an open-close mechanism of a cabinet of the second embodiment of the present invention.
Figure 9:
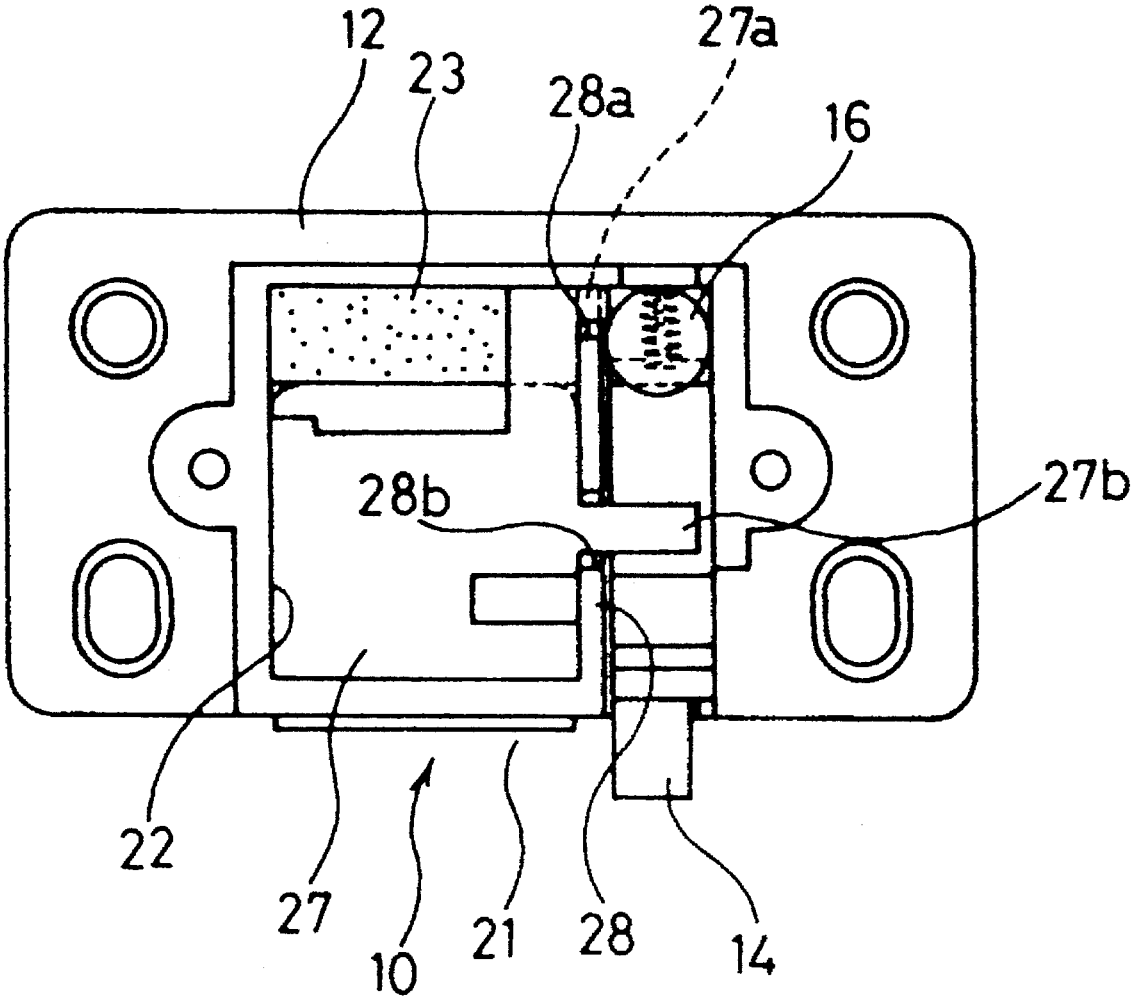
FIG. 9 is plan view of the assembled lock unit of FIG. 8.
Figure 10:
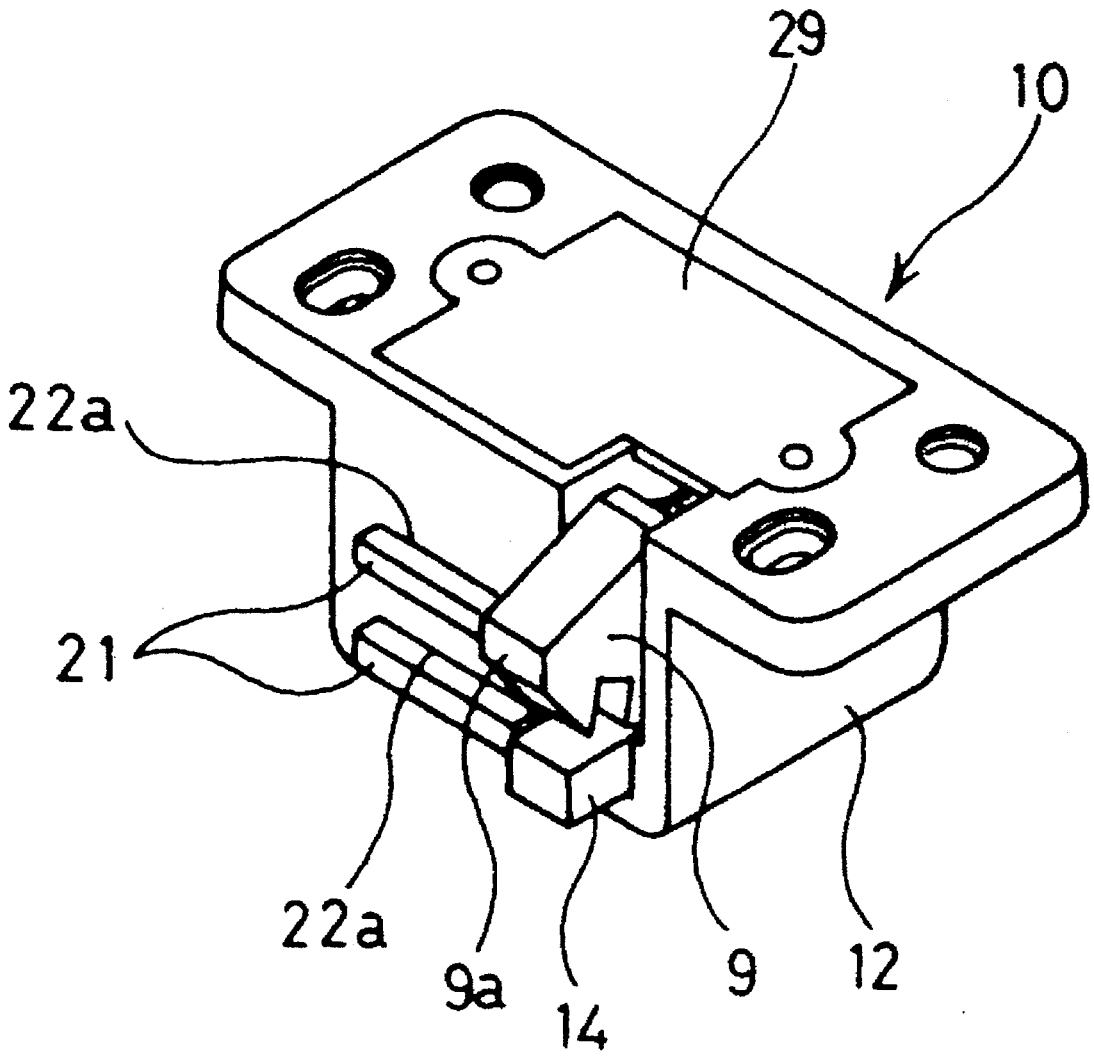
FIG. 10 is a perspective view of the lock unit of FIG. 8.

Once the earthquake or the like subsides and the normal state is restored, operations occur as shown in FIG. 6. Namely, one pushes the door 2 slightly, and the control lever 14 will retreat. At that time, the control lever 14 having the hinge 17 bends in a conical shape with the hinge 17 at the peak. With this bending, the rear part of the control lever 14 inclines in a way to be lower at the rear end and the rolling body 16 rolls out in the backward direction to return to its initial position. As a result, the lock lever 9 is free to turn, enabling opening of the door 2.

Figure 3:
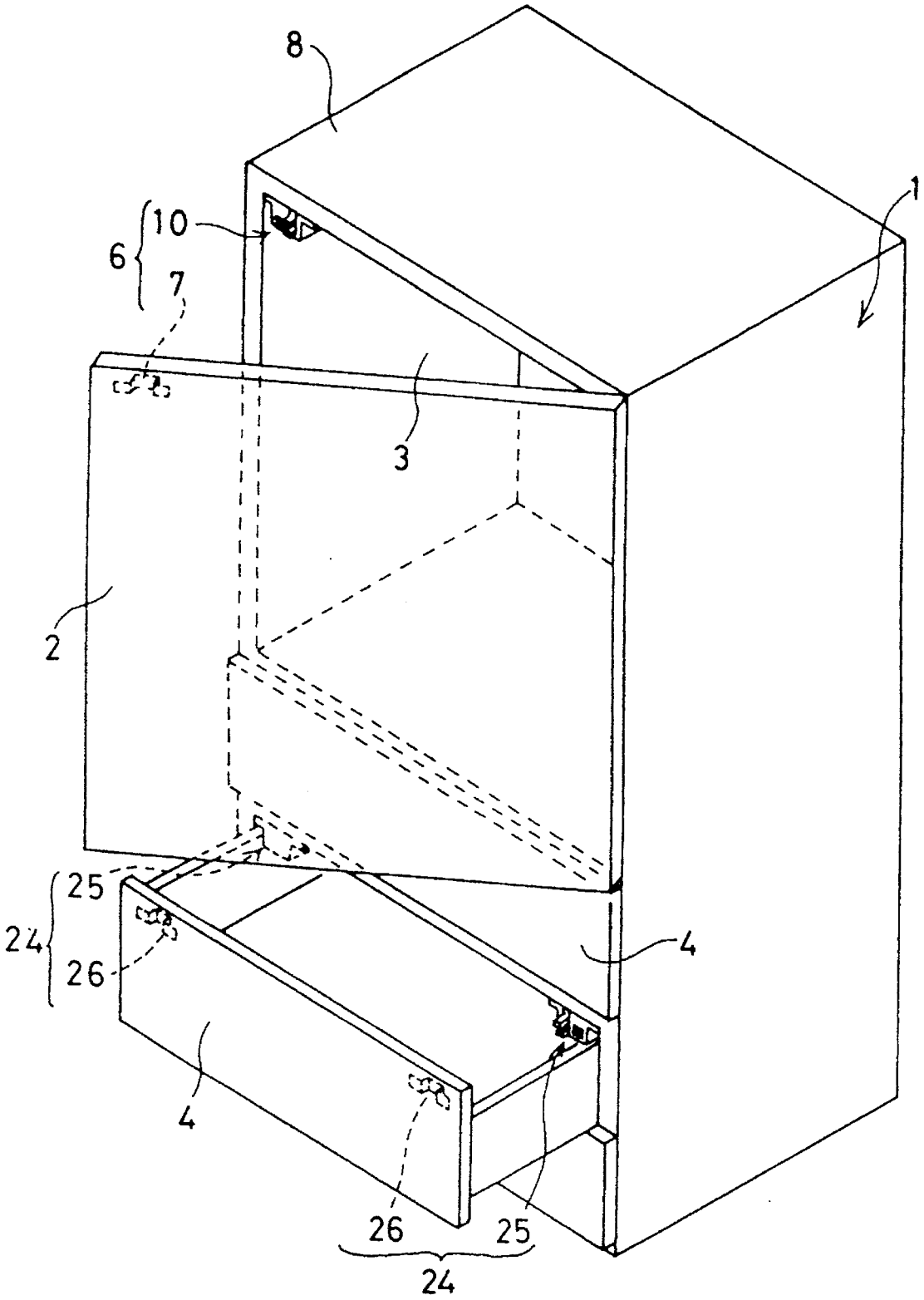
FIG. 3 is a perspective view in the state where a door and drawers, which are open-close mechanisms, are attached to a cabinet.

The above explanation concerns the locking operation of the door 2 but the locking operation for the drawers 4 indicated in FIG. 3 is the same. A locking device 24 consisting of a fastening fixture 26 and a lock unit 25 as mentioned earlier is provided also for drawer 4. An explanation of the construction and the action of locking device 24 will be omitted because it is the same as that given for the locking device 6 earlier.

Next, the second embodiment will be explained hereafter with reference to FIG. 8– FIG. 13.

This second embodiment is characterized in that the rolling body 16 as provided in the first embodiment is a ball made of a ferromagnetic material and that a means for magnetically controlling the position of the ball 16 is provided.

To be secured in position, a thin magnetic metal plate 27 is placed on the top face of the upper magnetic metal sheet 21 of the two magnetic metal sheets 21, 21 holding the magnet 19 of the magnetic catcher 20. The magnetic metal plate 27 has two tongues 27*a*, 27*b* serving as magnetic poles. One of the tongues 27*a* protrudes to contact the ball 26 when located at the rear end position while the other tongue 27*b* protrudes to contact the ball 26 when located at the front position. Furthermore, the tongue 27*a* is made shorter to have smaller magnetic attractive power and the tongue 27*b* is made longer to have larger magnetic attractive power.

A dent 9*e* is provided at the bottom face of the lock lever 9 to avoid interference of the tongue 27*b* with rotation of the lock lever 9. Moreover, a separator 28 is provided in the storing unit 22 of the base member 12. The ferromagnetic metal plate 27 is designed to be held by a lid 29.

Figure 11:
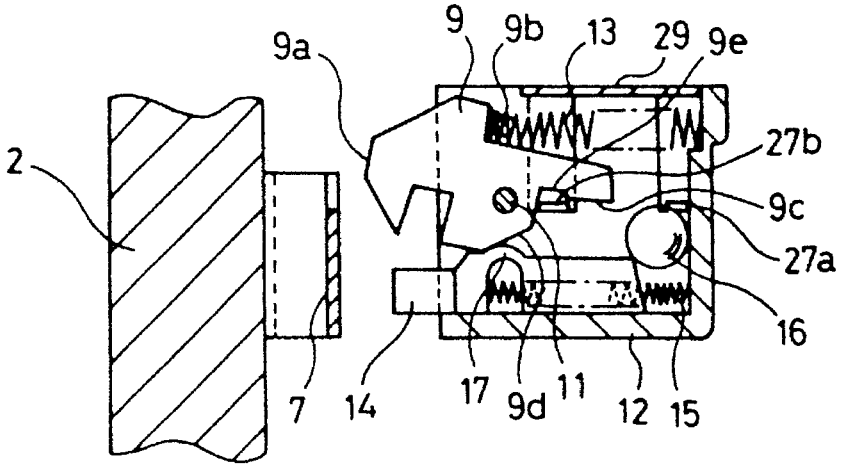
FIG. 11 is a cross-sectional view of the lock unit in the state where the door is open.

If, in the construction of the second embodiment described above, the door 2 is opened, the control lever 14 is pushed by the second spring 15 and protrudes forward at the maximum distance from the base member 12 as shown in FIG. 11. The hinge 17 at the upper face of the control lever 14 hits against the tapered face 9*d* and makes the lock lever 9 turn in the releasing direction. At this time, the ball 16 is attracted by a weak magnetic force of the tongue 27*a* flowing from the magnet 19.

Figure 12:
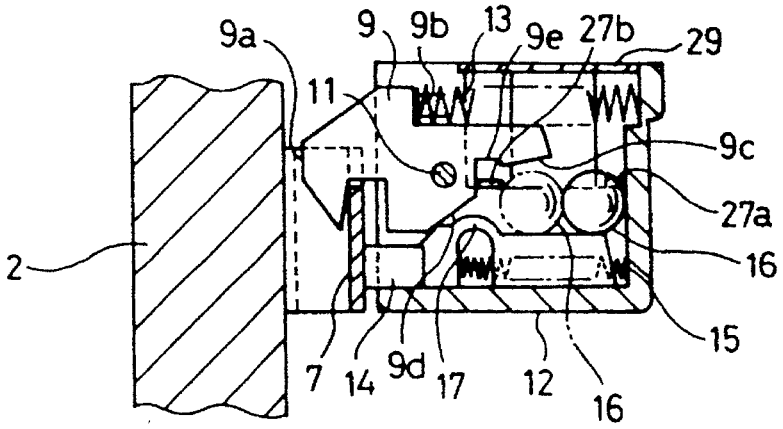
FIG. 12 is a cross-sectional view of the lock unit in the state where the door is closed.
Figure 13:
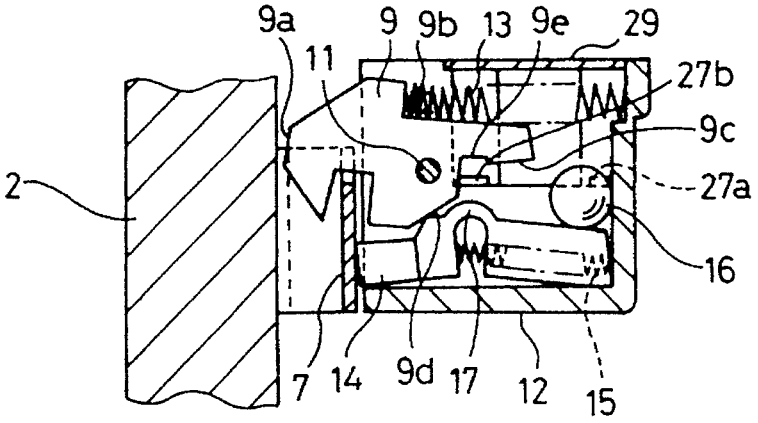
FIG. 13 is a cross-sectional view of the lock unit in unlocked state with the door closed.
Figure 14:
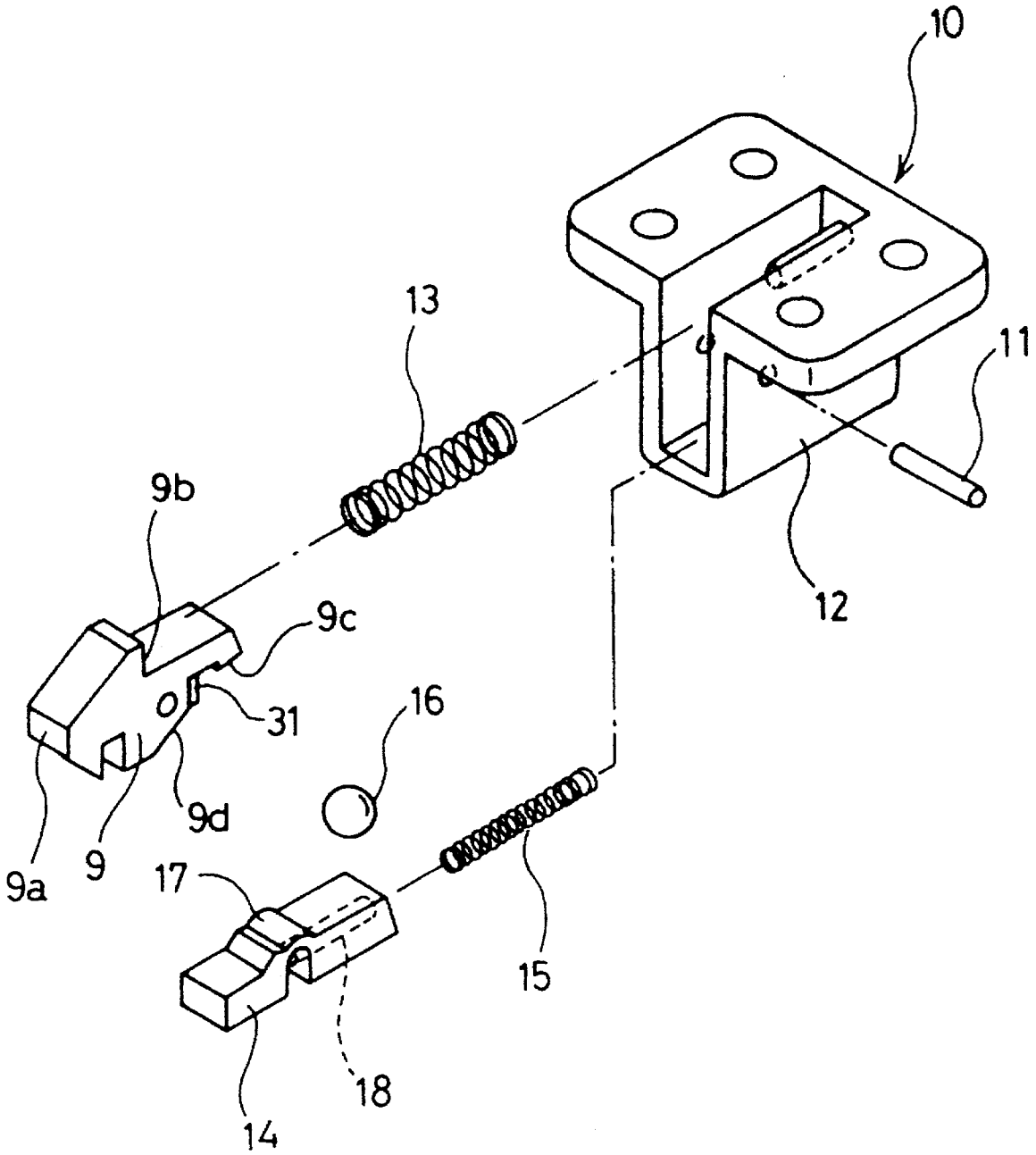
FIG. 14 is an exploded perspective view of the lock unit in the locking device for an open-close mechanism of a cabinet of the third embodiment of the present invention.
Figure 15:
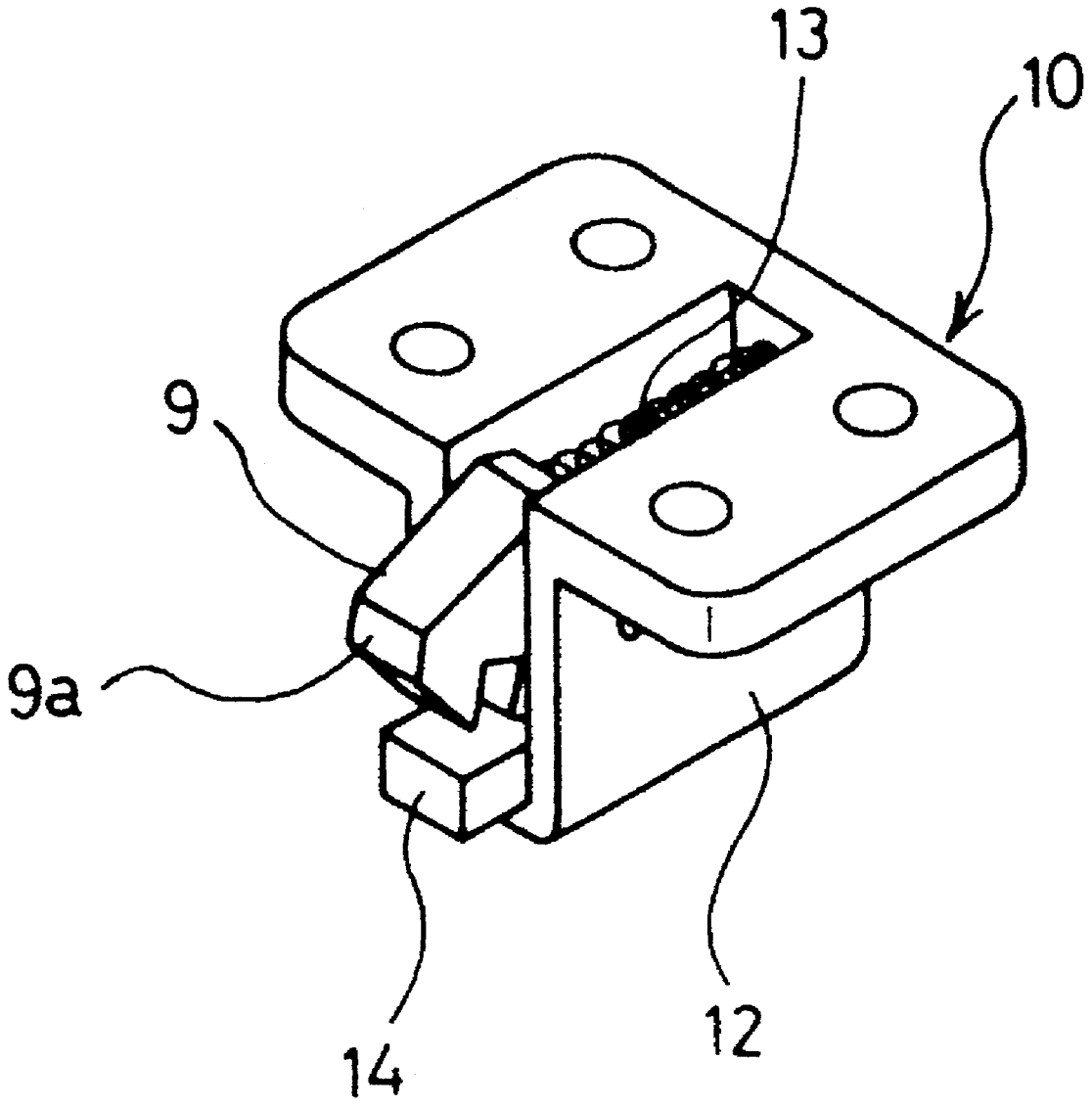
FIG. 15 is a perspective view of the lock unit of FIG. 14.

If the door 2 is closed as in FIG. 12, the fastening fixture 7 attached to the door 2 pushes the control lever 14. As the control lever 14 retreats, the lock lever 9 rotates in the closing direction under the force of the first spring 13. The hook 9*a* of the lock lever 9 engages with the fastening fixture 7. The fastening fixture 7 is attracted by the magnet catcher 20.

During normal conditions, the door 2 is closed in this state. To open the door 2, one pulls the door 2 in the forward direction with a force larger than the attractive force of the magnetic catcher 20 to release the hook 9a from the fastening fixture 7.

If, in the state where the door 2 is closed as shown in FIG. 12, the cabinet 1 swings from the force of an earthquake or the like, the ball 16 positioned in the rear part breaks away from the weak magnetic force of the tongue 27*a* and rolls forward to be attracted by the tongue 27*b* having a stronger magnetic attraction. Such position is indicated with a two-dot chain line. At this position of the ball 16, the lock lever 9 cannot turn, the hook 9*a* is engaged with the fastening fixture 7 and the door 2 remains in the closed state. As a result, opening of the door 2 is avoided, preventing the articles stored in the cabinet from falling out and thus improving the safety.

If the earthquake and the like subsides and the normal state is restored, the control lever 14 bends, with a push of door 2, in a conical shape with the hinge 17 at the peak and the ball 16 is pushed out in the backward direction to return to its initial position. Especially in this embodiment, the locked state is ensured because the ball 16 is held by the magnetic attraction of the tongue 27*b* and is maintained in that position even if it is subject to some shocks or vibrations.

Next, the third embodiment will be explained hereafter with reference to FIG. 14–FIG. 17. This third embodiment is characterized in that a magnetic means is provided for stabilizing the two positions of the ball controlling the turning of the lock lever.

To secure the ball 16, it is made of a ferromagnetic material, and a magnet 30 for attracting the ball 16 is secured at the rear end of the base member 12. A magnet 31 is also secured at the front end of the dent 9*c* at the bottom side of the lock lever 9. The attractive powers of the magnets 31 and 30, which are rather small, are selected such that the attractive power of the magnet 30 is comparatively smaller than that of the magnet 31.

Figure 16:
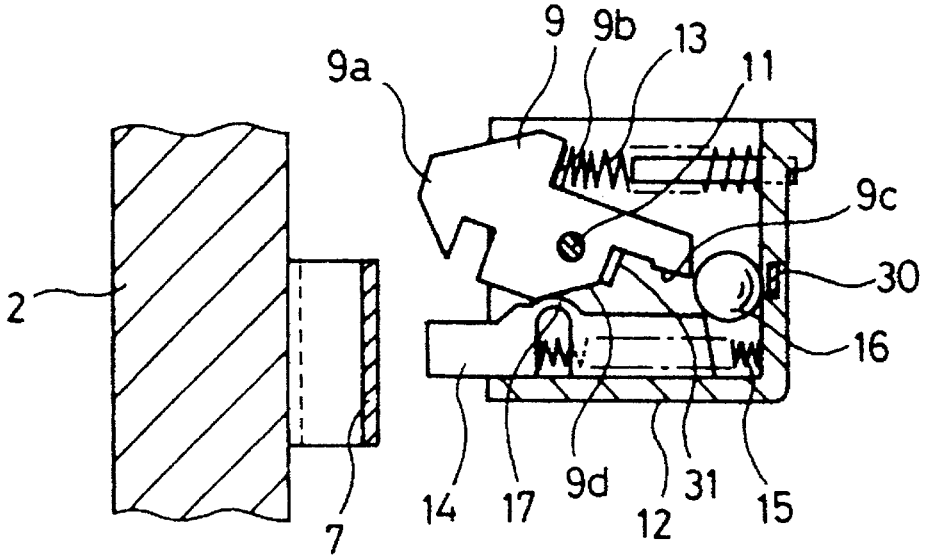
FIG. 16 is a cross-sectional view of the lock unit in the state where the door is open.

In this construction, under normal conditions without an earthquake or the like, the ball 16 is attracted by the magnet 30 as shown in FIG. 16 and does not roll in under the lock lever 9 even if it is subject to some vibrations, allowing the lock lever 9 to rotate normally.

Figure 17:
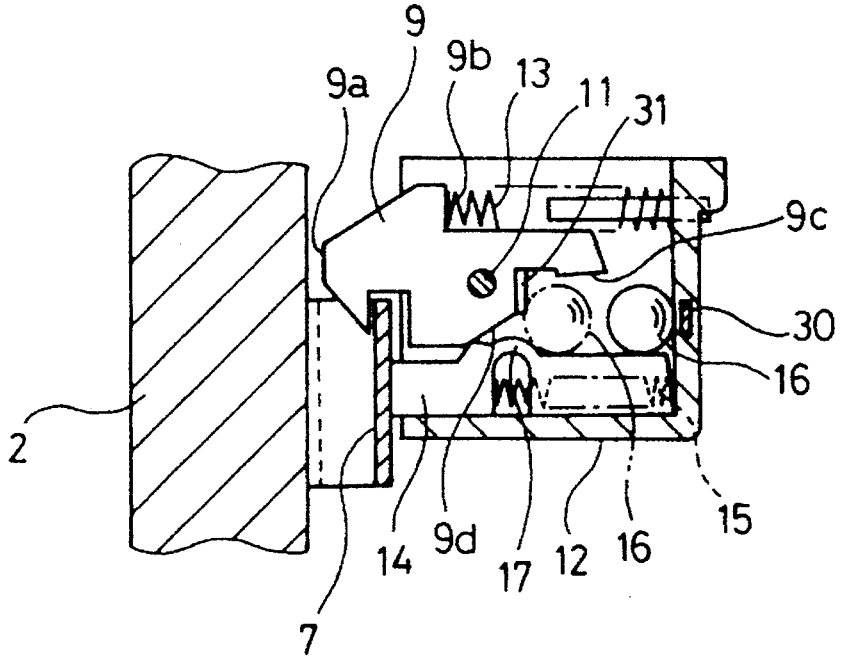
FIG. 17 is a cross-sectional view of the lock unit in the state where the door is closed.

In case of swinging of the cabinet 1 under the force of an earthquake or the like, the ball 16 can release from the magnet 30 and rolls in the forward direction as indicated with a two-dot chain line in FIG. 17. The ball 16 is then attracted by the magnet 31 of the lock lever 9 and maintains the lock lever 9 in the fastened state, preventing it from turning.

If the earthquake and the like subsides and the normal state is restored, the control lever 14 is bent, with a push of door 2 in the same way as the embodiments mentioned earlier, and the ball 16 moves to the rear part by rolling on the top face in the rear part of the control lever 14. The magnet 31 is selected with an attractive power weak enough to allow such movement.

In this third embodiment, the ball 16 does not roll out in the forward direction if the top face at the rear half of the control lever 14 is inclined with the front part up, making it possible to omit the magnet 30 at the rear end of the base member 12.

In this third embodiment, no magnetic catcher as that disclosed in the first and second embodiments is provided.

What is claimed is:

1. A locking device for locking an open-close mechanism such as door on a cabinet, to be freely opened and closed, comprising a fastening member attached to either the open-close mechanism or the cabinet and a lock unit attached to the other counterpart at a position corresponding to the fastening member, characterized in that:

the lock unit comprises a lock lever having a hook at front end, a control lever, first and second springs, a base member and a rolling body supported on the control lever, the lock lever being rotatably supported by a horizontal shaft on the base member of the lock unit and pressed by the first spring in such a way that the hook moves downward, said lock lever including a lower side having a tapered face for receiving a force for moving the hook upwardly, the control lever being provided beneath the lock lever for sliding movement in a longitudinal direction under force from the second spring, said second spring having a larger pressing force relative to the first spring, the front part of said control lever protruding from the base member, said control lever including a projection for pressing against the tapered face of the lock lever, said control ever including a central part adapted to bend in a conical shape upon application of a force in the axial direction causing the rolling body supported thereon to roll out of the turning range of the lock lever, and said rolling body being positioned in between a bottom face of the lock lever and a top face of the control lever when the cabinet swings thereby preventing rotation of the lock lever.

2. A locking device as in claim 1, wherein the fastening member is formed of a ferromagnetic material and the lock unit includes a magnetic catcher.

3. A locking device as in claim 1, wherein the control lever includes, at about the center of the top face of the control lever, a projection for pushing against the tapered face of the lock lever, said projection being constructed as a thin hinge serving as fulcrum.

4. A locking device as in claim 1, wherein the rolling body is a ball.

5. A locking device as in claim 1, wherein the rolling body is formed as a ball made of a ferromagnetic material and including means for magnetically attracting the ball, said attracting means located at positions in front and in the rear of the ball.

6. A locking device as in claim 1, wherein the rolling body is formed as a ball made of a ferromagnetic material, said lock unit including a magnetic catcher having a magnet and two magnetically attractive tongues positioned in front and in the rear of the ball.

7. A locking device as in claim 6, wherein the tongue at the rear position has a smaller magnetic attractive force than that of the tongue at the front position.

8. A locking device as in claim 6, wherein the length of the tongue at the rear position is shorter than that of the tongue at the front position and the magnetic attractive force of the tongue at the rear position is smaller than that of the tongue at the front position.

9. A locking device as in claim 6, wherein the lock lever includes a dent corresponding to the tongue at the front position, said dent being formed at a bottom face of the lock lever.

10. A locking device as in claim 1, wherein the rolling body is formed as a ball made of a ferromagnetic material and including a magnet for attracting and holding the ball in a front position.

11. A locking device as in claim 1, wherein the rolling body is formed as a ball made of a ferromagnetic material and including two magnets for attracting and holding the ball in a front position and a rear position.

12. A locking device as in claim 10, wherein the magnetic attractive power of the magnet corresponding to the front position of the ball is larger than that of the magnet corresponding to the rear position.

13. A locking device as in claim 1, wherein the rolling body is formed as a ball made of a ferromagnetic material and including two magnets for attracting and holding the ball, a first one of said magnets being located at a lower part of the lock lever, and a second one of said magnets being located in a rear part of the base member.

* * * * *

UNITED STATES PATENT AND TRADEMARK OFFICE

CERTIFICATE OF CORRECTION

PATENT NO. : 5,518,282

DATED : May 21, 1996

INVENTOR(S) : Hiroshi Sawada

It is certified that error appears in the above-identified patent and that said Letters Patent is hereby corrected as shown below:

Column 7, claim 1, line 7, add -- a -- before front.

Signed and Sealed this

Twenty-fourth Day of September, 1996

*Attest:*

Bruce Lehman

BRUCE LEHMAN

*Attesting Officer*

*Commissioner of Patents and Trademarks*